US006598867B2

(12) United States Patent
Martinez

(10) Patent No.: US 6,598,867 B2
(45) Date of Patent: Jul. 29, 2003

(54) VISE SYSTEM

(75) Inventor: Gustavo R. Martinez, Huntington Beach, CA (US)

(73) Assignee: Conquest Industries, Inc., Santa Fe Springs, CA (US)

( * ) Notice: Subject to any disclaimer, the term of this patent is extended or adjusted under 35 U.S.C. 154(b) by 7 days.

(21) Appl. No.: 09/976,952

(22) Filed: Oct. 11, 2001

(65) Prior Publication Data

US 2003/0071402 A1 Apr. 17, 2003

(51) Int. Cl.[7] ..... B25B 1/20

(52) U.S. Cl. ..... 269/43; 269/136; 269/154; 269/906; 269/283; 269/286

(58) Field of Search ..... 269/43, 136, 154, 269/906, 283, 286, 279, 152–153, 99, 280, 282, 900, 73

(56) References Cited

U.S. PATENT DOCUMENTS

| | | | | |
|---|---|---|---|---|
| 2,641,947 A | | 6/1953 | Werne | |
| 4,934,674 A | | 6/1990 | Bernstein | |
| 5,022,636 A | * | 6/1991 | Swann | 269/43 |
| 5,098,073 A | * | 3/1992 | Lenz | 269/43 |
| 5,242,159 A | | 9/1993 | Bernstein | |
| 5,351,943 A | * | 10/1994 | Milz | 269/246 |
| 5,649,694 A | | 7/1997 | Buck | |
| 5,683,077 A | * | 11/1997 | Fink et al. | 269/244 |
| 5,893,551 A | | 4/1999 | Cousins et al. | |
| 5,975,511 A | * | 11/1999 | Bohler | 269/43 |
| 5,984,290 A | | 11/1999 | Durfee, Jr. | |
| 6,012,712 A | | 1/2000 | Bernstein | |

* cited by examiner

*Primary Examiner*—Joseph J. Hail, III
*Assistant Examiner*—Daniel Shanley
(74) *Attorney, Agent, or Firm*—Kelly Bauersfeld Lowry & Kelley, LLP

(57) ABSTRACT

A vise system including a plurality of jaws associated with a vise body. A first jaw is attached to a first shaft which are both slidable with respect to the vise body. A second jaw is attached to a second shaft which are both slidable with respect to the vise body independent of the first jaw and first shaft. A locking mechanism is associated with the first and second shafts for locking the first and second shafts, and first and second jaws, in place. The locking mechanism includes a first collet partially surrounding the first shaft, and an aligned second collet partially surrounding the second shaft. First and second stops are operatively connected to a handle so that as the handle is turned, the first and second stops engage the respective first and second collets to compress the collets over the shafts to immobilize them.

19 Claims, 3 Drawing Sheets

VISE SYSTEM

BACKGROUND OF THE INVENTION

The present invention generally relates to vises. More particularly, the present invention relates to a vise system which enables clamping of work pieces of different sizes very rapidly.

It is common practice to utilize a vise for securing a work piece when performing a manufacturing operation on the work piece. Such vises are typically utilized on precision machining equipment to hold a work piece during a defined machining operation. Such vises typically employ a pair of moving jaws and, in many of the prior structures, at least one fixed central jaw so as to simultaneously hold two work pieces to permit a single work station to simultaneously perform machining operations on two different work pieces. Such vises typically include two outward jaws which are simultaneously moved towards a central stationery jaw, such as by hydraulics or oppositely threaded shafts, to clamp the two objects simultaneously. Alternatively, one of the moving jaws may be connected in a non-threaded manner to the drive shaft so as to move toward the fixed jaw only after the other moving jaw has been moved into a work piece engaging position with the fixed jaw.

However, the vises of the prior art have certain drawbacks in that often times the objects to be clamped must be of the same size as the outward jaws are simultaneously moved towards the fixed jaw. There are vises which allow objects of different sizes to be clamped, such as that described in U.S. Pat. No. 5,649,694. However, these vises require many manual turns of the handle, to clamp one of the jaws, engaging a brake and then actuating the other jaw by turning the handle several turns again. These devices have been found to be very time consuming, resulting in increased costs of the products manufactured.

Accordingly, there is a need for a vise which enables the secure clamping of objects of different sizes. Such a vice should be easy to operate and permit the clamping of the objects very rapidly. The present invention fulfills these needs and provides other related advantages.

SUMMARY OF THE INVENTION

The present invention resides in a vise system which allows the secure clamping of two objects of equal or different sizes simultaneously in a fast and easy manner. The vise system generally comprises a vise body and a plurality of jaws associated with the body, including a first jaw slidably disposed on the vise body and a stationery jaw attached to the vise body. A first shaft is attached to the first jaw and slidable with respect to the vise body as the first jaw is moved. A locking mechanism is associated with the first shaft for locking the first shaft, and first jaw in place.

In a particularly preferred embodiment, a second jaw is slidably disposed on the vise body independent of the first jaw. A second shaft is attached to the second jaw and slidable with respect to the vise body independent of the first shaft as the second jaw is moved. Typically, the first and second shafts are concentric with one another.

The locking mechanism includes a first collet having an aperture through which the first shaft slidably travels. In the preferred embodiment, a second collet is generally aligned with the first collet and includes an aperture through which the second shaft slidably travels. First and second stops have ends which are configured to engage and compress the respective first and second collets. The first and second stops have threads of opposite hand. A handle is connected to a rotatable sleeve, which is connected to first and second nuts threadably engaged with the respective first and second stop distal the handle.

As the handle is turned, the sleeve and nuts rotate causing the first and second stops to move apart from one another and compress the adjacent ends of the respective first and second collets to immobilize the first and second shafts, and first and second jaws. The first and second stops adjacent to the respective first and second collets each include an aperture having internally tapered side walls which compress the ends of the first and second collets as the first and second stops are increasingly moved towards to respective first and second collet ends.

In operation, one or more objects are placed between a movable jaw and the fixed jaw. The movable jaws are then slid into contact with the object manually. The handle is then turned, typically less than one turn, to hold the jaws, and objects, in place.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
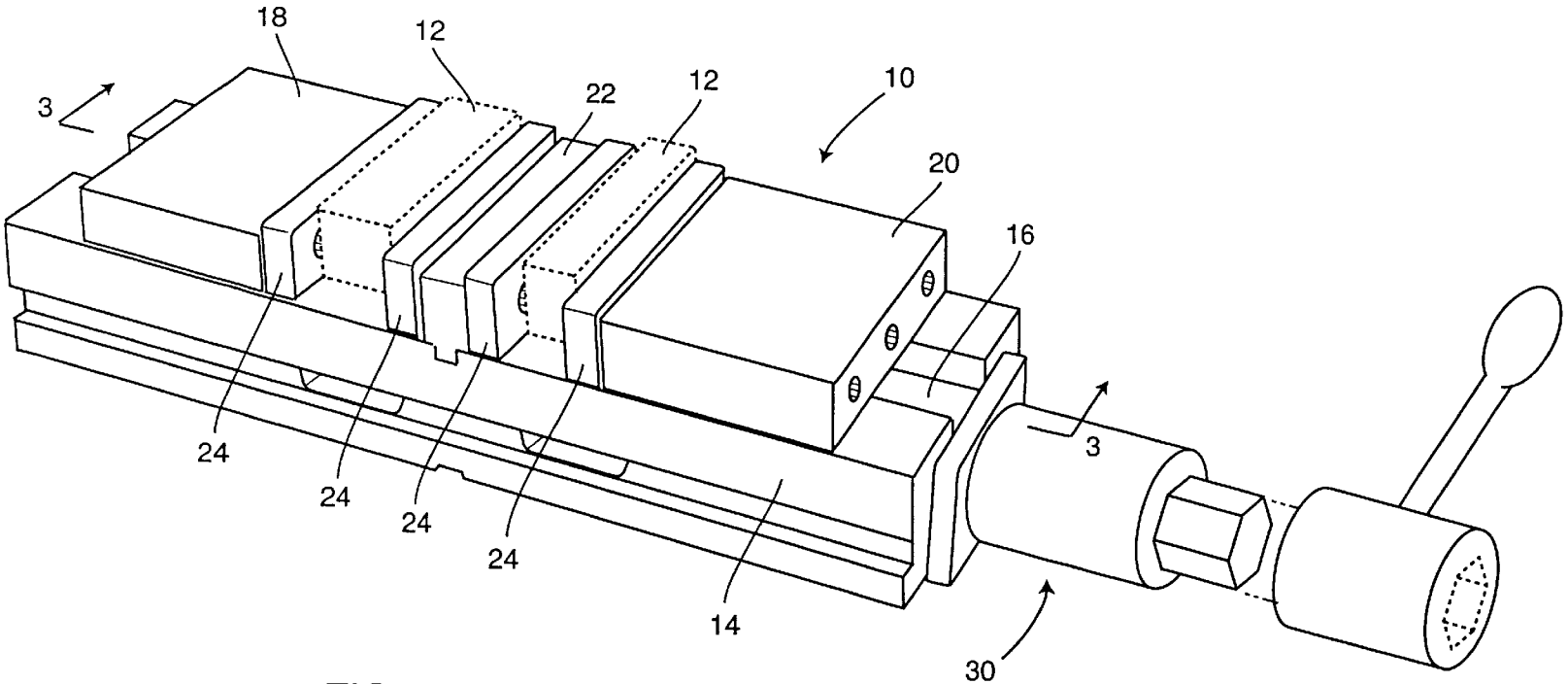
FIG. 1 is a perspective view of a vise system embodying the invention, clamping two objects therein.

As shown in the drawings for purposes of illustration the present invention is concerned with a vise, generally referred to by the reference number 10. The vise 10 is designed to hold and securely clamp objects 12, which may. be of different sizes, in a quick and easy manner.

Referring to FIG. 1, the vise 10 includes a vise body 14 having a track 16 on an upper surface thereof upon which are slidably mounted clamping jaws 18 and 20. A stationery jaw 22 is fixed to the vise body 14 and positioned between the jaws 18 and 20. The vise body 14 and jaws 18–22 are typically comprised of a hard and durable material, such as metal. In order to prevent scratching, marring and other damage to the objects 12, the jaws 18–22 may have pads 24 attached thereto which are comprised of a softer material. Although a vise 10 having two outward jaws 18 and 20 is illustrated and described, it should be understood by the reader that a vise 10 having only one slidable jaw 18 or 20 and a fixed stationery jaw 22 is also contemplated by the invention. However, as can be appreciated by those skilled in the art, the use of two outward movable jaws 18 and 20 allows the user of the vise 10 to beneficially hold two objects simultaneously further increasing the productivity of the worker.

Figure 2:
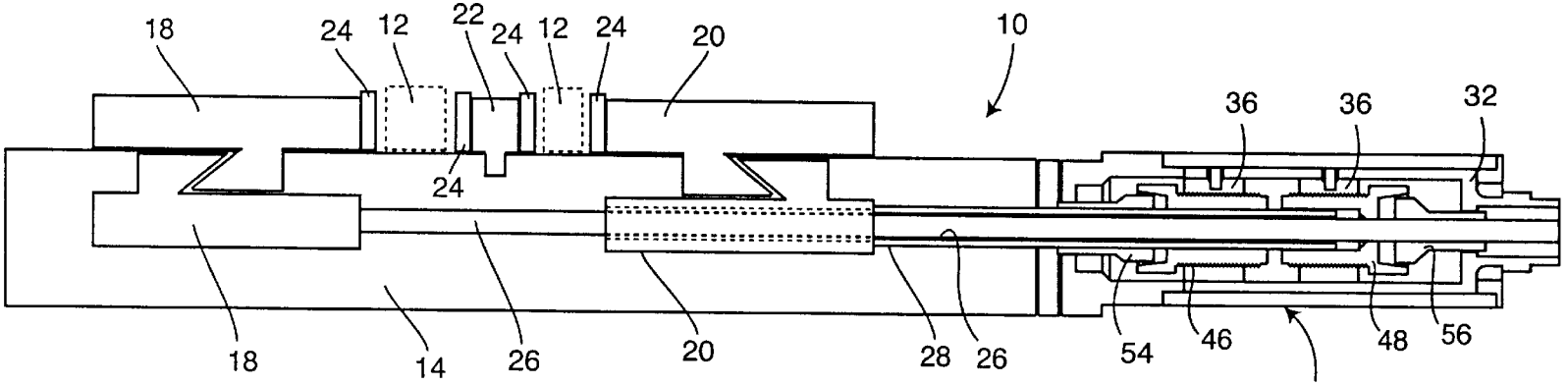
FIG. 2 is a side cross-sectional view of the vise system of FIG. 1, illustrating an outer jaw thereof in an unclamped position.
Figure 3:
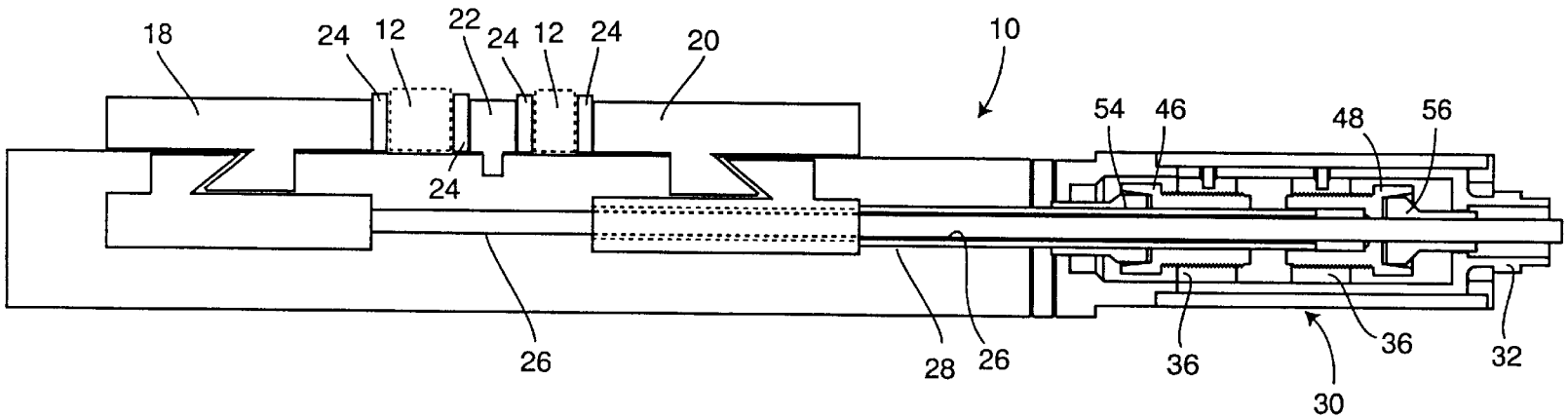
FIG. 3 is a side cross-sectional view taken generally along line 3—3. of FIG. 1, illustrating the jaws in a clamped and closed position.

With reference now to FIGS. 2–3, the left clamping jaw 18 extends into the vise body 14, or it is attached to a corresponding piece which moves with the clamping jaw 18. Within the vise body 14 the clamping jaw 18 is attached to a first shaft 26. This shaft 26 slides within the vise body 14 as the clamping jaw 18 is manually slid on track 16. Similarly, the right movable clamping jaw 20 extends into the vise body 14, or is connected to a corresponding piece, and is attached to a second shaft 28 which slides with respect to the vise body 14 independent of the first shaft 26 as the right jaw 20 is manually slid along the vise track 16. The first shaft 26 extends through the inner portion of the right clamping jaw 20 and second shaft 28, so as to be positioned concentric with the second shaft 28. The first and second shafts 26 and 28 extend through the vise body 14 and into a locking mechanism 30 attached at an end of the vise body 14.

Figure 4:
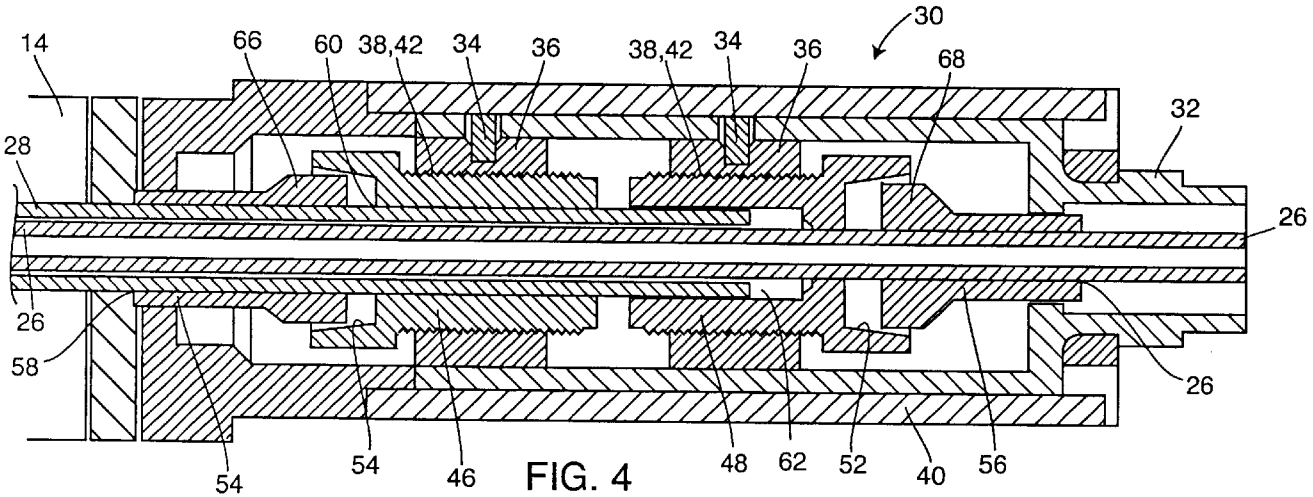
FIG. 4 is an enlarged sectional view of a locking mechanism used in accordance with the present invention in an unlocked state.
Figure 5:
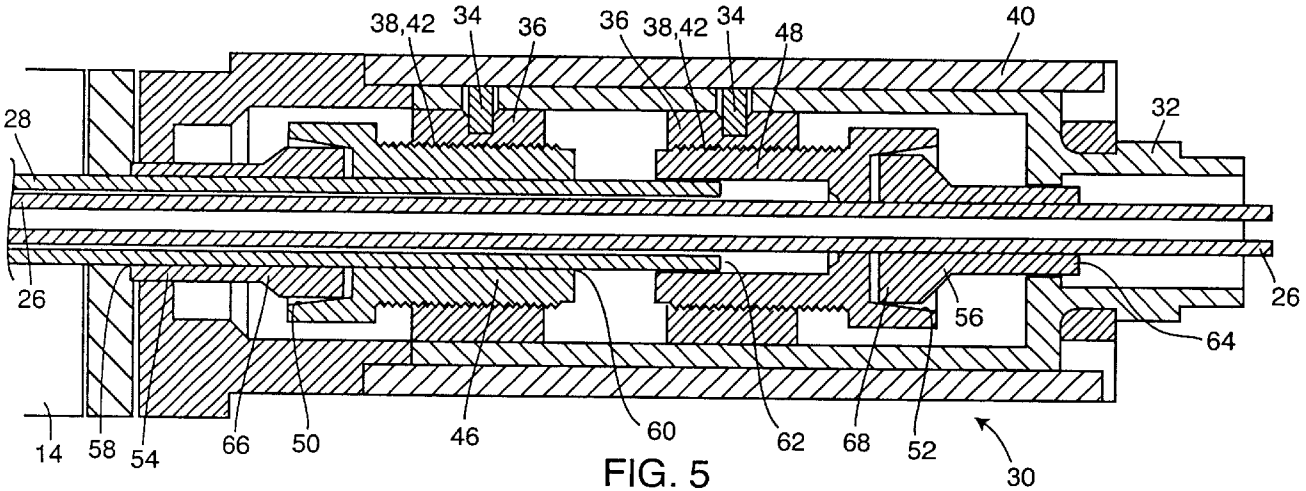
FIG. 5 is a sectional view of the locking mechanism of the present invention in a locked state.

With reference now to FIGS. 4 and 5, enlarged sectional views of the locking mechanism 30 are shown. The locking mechanism 30 includes a generally circular sleeve 32 which has an end extending from the locking mechanism 30 for attachment to a handle 31. The sleeve 32 has pins 34 extending through the sleeve 32 and into two nuts 36 which are internally threaded 38. Thus, as the handle is turned, the sleeve 32 is rotated within a body 40 of the locking mechanism 30 causing the circular nuts 36 to rotate by the same degree of rotation.

The internal threads 38 of the nuts 36 are engaged with external threads 42 and 44 of first and second stops 46 and 48. The first and second stops external threads 42 and 44 are of opposite hand so that as the nuts 36 are rotated, the first and second stops 46 and 48 move in opposite directions. Each stop 46 and 48 has an open end 50 and 52 which is bowl-shaped, or otherwise configured to have internally tapered side walls as will be more fully described herein.

The locking mechanism 30 includes two collets 54 and 56 which are attached to the body 40 at substantially opposite ends of the locking mechanism 30 so as to remain stationery. The collets 54 and 56 are generally aligned with one another, and the stops 46 and 48. The collet 54 closest to the vise body 14 includes a central aperture 58 which is sized to slidably accept the first and second concentric shafts 26 and 28 therethrough. The first stop 46 similarly has an aperture therethrough sized to slidably accept the first and second shafts 26 and 28. The second stop 48 may have a central aperture 62 sized to accept both the first and second shaft 26 and 28, or only the longer internal shaft 26 as dictated by the design of the vise 30. The second collet 56 includes a central internal aperture 64 extending therethrough and sized to slidably accept the first internal shaft 26. The internal first shaft 26 is of a much greater length than the external second shaft 28, and may even extend without the locking mechanism 30 depending upon the position of the left clamping jaw 18. It should be understood by the reader that the designations "right" and "left" when referring to the jaws 18 and 20 are for exemplary purposes only, it being understood that such terms are interchangeable depending upon the location of the locking mechanism 30 with respect to the jaws 18 and 20.

Each collet 54 and 56 has an end 66 and 68 facing a stop 46 and 48, respectively, which is resiliently flexible and capable of being compressed onto the shaft 26 or 28 as the open end 50 and 52 of the stops 46 and 48 are increasingly brought towards the collet end 66 and 68. Typically, the collet ends 66 and 68 are of increased thickness compared to the remainder of the collet 54 and 56, and include slots (not shown) to facilitate the compression onto the shafts 26 or 28, and release from the shafts 26 and 28.

The end 66 of the first collet 54 compresses against the second outward shaft 28 as the first stop 46 is increasingly brought towards the collet 54 and the tapered internal wall of the open end 50 of the stop 46 compresses the end 66 of the collet 54. This renders the second shaft 28 immobile, in turn rendering the right clamping jaw 20 to which it is attached immobile. As the second stop 48 is brought towards the second collet 56, the tapered opened end 52 of the stop 48 increasingly applies pressure against the resilient end 68 of the collet 56 and causes the end 68 to clamp onto the internal first shaft 26 and immobilize it, and thus the left clamping jaw 18. Of course, the first and second stops 46 and 48 are brought towards their respective first and second collets 54 and 56 by turning the handle causing the sleeve 32, and nuts 36 to rotate as described above. A unique aspect of the present invention is that typically less than one turn of the handle, sometimes as little as ¼ of one turn, is required in order to move the stops 46 and 48 sufficiently to clamp the collets 54 and 56 onto their respective shafts 28 and 26.

In use, objects which are to be clamped are inserted between the left and right movable jaws 18 and 20, and the stationery jaw 22. The clamping jaws 18 and 20 are manually slid into contact with the objects 12 until the object 12 is sufficiently clamped between the jaw 18 or 20 and the stationery jaw 22. It should be understood by the reader that the jaws 18 and 20 are independently slid relative to the vise body 14. This allows objects 12 of different sizes to be clamped by the vise 10. As the clamping jaws 18 and 20 are manually positioned in place, the first and second shafts 26 and 28 are likewise slid back and forth through the vise body 14 and locking mechanism 30. So long as the stops 46 and 48 are not compressing the ends 66 and 68 of the collets 54. and 56, the shafts 26 and 28 and the jaws 18 and 20 are freely moved. Once the jaws 18 and 20 are in place, the handle is turned to rotate the sleeve 32 and attached nuts 36, causing the stops 46 and 48 to move in opposite direction and increasingly compress the ends 66 and 68 of the collets 54 and 56 onto their respective shafts 28 and 26, rendering the shafts 26 and 28 immobile. After the desired machining etc. is performed on the objects 12, the handle is turned, typically less than one full turn, and the jaws 18 and 20 can be manually slid away from the objects 12 for the removal and insertion of new objects 12.

It will be appreciated by the reader that a worker needs very little if any training in order to operate the vise 10 of the present invention due to its intuitive design. As the handle need only be rotated a fraction of a turn, the worker does not expend a considerable amount of time clamping the objects 12 into place. This increases productivity, and decreases the cost of producing the finished objects 12.

Although an embodiment of the present invention has been described in detail for purposes of illustration, various modifications may be made without departing from the spirit and scope of the invention. Accordingly, the invention is not to be limited, except as by the appended claims.

What is claimed is:

1. A vise system, comprising:

a vise body;

a plurality of jaws associated with the body, including a first jaw slidably disposed on the vise body, a second jaw slidably disposed on the vise body independent of the first jaw, and a stationary jaw attached to the vise body and positioned between the first and second jaws;

a first shaft attached to the first jaw and slidable with respect to the vise body as the first jaw is moved;

a second shaft attached to the second jaw and slidable with respect to the vise body independent of the first shaft as the second jaw is moved; and a locking mechanism associated with the first and second shafts for locking the first and second shafts, and first and second jaws, in place.

2. The vise system of claim 1, wherein the first and second shafts are concentric with one another.

3. The vise system of claim 1, wherein the locking mechanism includes:

a first collet having an aperture through which the first shaft slidably travels;

a first stop having an end configured to engage and compress an end of the first collet;

a second collet having an aperture through which the second shaft slidably travels; and a second stop having an end configured to engage and compress an end of the second collet;

whereby upon actuating the first and second stops, the first and second collets are compressed around the respective first and second shafts immobilizing the first and second shafts, and first and second jaws.

4. The vise system of claim 3, wherein the first and second collets are generally aligned with one another and the first and second shafts are concentric with one another.

5. The vise system of claim 3, wherein the ends of the first and second stops adjacent to the respective first and second collets each include an open end having internally tapered sidewalls which compress the ends of the first and second collets as the first and second stops are increasingly moved towards the respective first and second collets.

6. The vise system of claim 3, wherein the locking mechanism further includes:

a handle;

a first nut operably connected to the handle and threadably engaged with the first stop; and a second nut operably connected to the handle and threadably engaged with the second stop, the second stop having threads of opposite hand than the first stop;

whereby upon actuating the handle, the first and second nuts are rotated causing the first and second stops to move apart from one another and compress the ends of the respective first and second collets.

7. The vise system of claim 6, including a rotatable sleeve connected to the handle at one end thereof and connected to the first and second nuts distal the handle, whereby turning the handle causes the sleeve and nuts to rotate and the first and second stops to move apart from one another.

8. A vise system, comprising:

a vise body;

a plurality of jaws associated with the body, including a first jaw slidably disposed on the vise body and a stationary jaw attached to the vise body;

a first shaft attached to the first jaw and slidable with respect to the vise body as the first jaw is moved; and a locking mechanism including a first collet having an aperture through which the first shaft slidably travels, and a first stop having an end configured to engage and compress an end of the first collet;

whereby upon actuating the first stop, the first collet is compressed around the first shaft immobilizing the first shaft, and the first jaw.

9. The vise system of claim 8, wherein the end of the first stop adjacent to the first collet includes an open end having internally tapered sidewalls which compress the end of the first collet as the first stop is increasingly moved towards the first collet.

10. The vise system of claim 8, wherein the locking mechanism further includes:

a handle;

a first nut operably connected to the handle and threadably engaged with the first stop; and a rotatable sleeve connected to the handle at one end thereof and connected to the first nut distal the handle, whereby turning the handle causes the sleeve and first nut to rotate and the first stop to move towards and compress the end of the first collet.

11. The vise system of claim 8, including a second jaw slidably disposed on the vise body independent of the first jaw and a second shaft attached to the second jaw and slidable with respect to the vise body independent of the first shaft as the second jaw is moved.

12. The vise system of claim 11, wherein the locking mechanism further includes:

a second collet having an aperture through which the second shaft slidably travels; and a second stop having an end configured to engage and compress an end of the second collet;

whereby upon actuating the first and second stops, the first and second collets are compressed around the respective first and second shafts immobilizing the first and second shaft, and first and second jaws.

13. The vise system of claim 12, wherein the first and second collets are generally aligned with one another and the first and second shafts are concentric with one another.

14. The vise system of claim 12, wherein the ends of the first and second stops adjacent to the respective first and second collets each include an open end having internally tapered sidewalls which compress the ends of the first and second collets as the first and second stops are increasingly moved towards the respective first and second collets.

15. The vise system of claim 12, wherein the locking mechanism further includes:

a first nut operably connected to the handle and threadably engaged with the first stop;

a second nut operably connected to the handle and threadably engaged with the second stop, the second stop having threads of opposite hand than the first stop; and a rotatable sleeve connected to the handle at one end thereof and connected to the first and second nuts distal the handle, whereby turning the handle causes the sleeve and nuts to rotate and the first and second stops to move apart from one another and compress the ends of the respective first and second collets.

16. A vise system, comprising:

a vise body;

a plurality of jaws associated with the body, including a first jaw slidably disposed on the vise body, a second jaw slidably disposed on the vise body independent of the first jaw, and a stationary jaw attached to the vise body and positioned between the first and second jaws;

a first shaft attached to the first jaw and slidable with respect to the vise body as the first jaw is moved;

a second shaft attached to the second jaw and concentric with the first shaft and slidable with respect to the vise body independent of the first shaft as the second jaw is moved; and a locking mechanism associated with the first and second shafts including:

a first collet having an aperture through which the first shaft slidably travels;

a first stop having an end configured to engage and compress an end of the first collet;

a second collet generally aligned with the first collet and having an aperture through which the second shaft slidably travels; and a second stop having an end configured to engage and compress an end of the second collet;

whereby upon actuating the first and second stops, the first and second collets are compressed around the respective first and second shafts immobilizing the first and second shaft, and first and second jaws.

17. The vise system of claim 16, wherein the ends of the first and second stops adjacent to the respective first and second collets each include an open end having internally tapered sidewalls which compress the ends of the first and second collets as the first and second stops are increasingly moved towards the respective first and second collets.

18. The vise system of claim 16, wherein the locking mechanism further includes:

a handle;

a first nut operably connected to the handle and threadably engaged with the first stop; and a second nut operably connected to the handle and threadably engaged with the second stop, the second stop having threads of opposite hand than the first stop;

whereby upon actuating the handle, the first and second nuts are rotated causing the first and second stops to move apart from one another and compress the ends of the respective first and second collets.

19. The vise system of claim 18, including a rotatable sleeve connected to the handle at one end thereof and connected to the first and second nuts distal the handle, whereby turning the handle causes the sleeve and nuts to rotate and the first and second stops to move apart from one another.

* * * * *